US010054123B2

(12) United States Patent
Nowitzki et al.

(10) Patent No.: US 10,054,123 B2
(45) Date of Patent: Aug. 21, 2018

(54) TORQUE TRANSFER SYSTEM FOR CENTRIFUGAL PUMPS

(71) Applicant: Summit ESP, LLC, Tulsa, OK (US)

(72) Inventors: Wesley John Nowitzki, Tulsa, OK (US); Thomas John Gottschalk, Houston, TX (US)

(73) Assignee: SUMMIT ESP, LLC, Tulsa, OK (US)

( * ) Notice: Subject to any disclaimer, the term of this patent is extended or adjusted under 35 U.S.C. 154(b) by 0 days.

(21) Appl. No.: 15/823,773

(22) Filed: Nov. 28, 2017

(65) Prior Publication Data

US 2018/0149157 A1 May 31, 2018

Related U.S. Application Data

(60) Provisional application No. 62/427,147, filed on Nov. 28, 2016.

(51) Int. Cl.
*F04D 13/02* (2006.01)
*F04D 29/044* (2006.01)
(Continued)

(52) U.S. Cl.
CPC ..... *F04D 13/022* (2013.01); *F04D 29/044* (2013.01); *F04D 29/046* (2013.01);
(Continued)

(58) Field of Classification Search
CPC ..... F04D 13/021; F04D 13/022; F04D 13/08; F04D 13/086; F04D 1/06; F04D 29/046;
(Continued)

(56) References Cited

U.S. PATENT DOCUMENTS 1,642,914 A 9/1927 Whann
2,271,336 A 1/1942 Goldsmith
(Continued)

FOREIGN PATENT DOCUMENTS

CN 102606490 A 7/2012
WO 2012050905 A1 4/2012
WO 2014201458 A1 12/2014

OTHER PUBLICATIONS

International Searching Authority, "International Search Report" for PCT Application No. PCT/US2017/063350, dated Feb. 9, 2018, 3 pages.

(Continued)

*Primary Examiner* — Christopher Verdier
(74) *Attorney, Agent, or Firm* — McGuire Woods LLP

(57) ABSTRACT

A torque transfer system for centrifugal pumps. A torque transfer system for a centrifugal pump includes a bearing sleeve above an impeller, the bearing sleeve and a hub of the impeller surrounding a rotatable shaft and coupled to the rotatable shaft by a key, the bearing sleeve having a stepped bottom edge, a top edge of the hub stepped inversely to the bottom edge of the bearing sleeve such that the top edge and the bottom edge interlock with a clearance between longitudinally extending portions of the interlocked edges, wherein upon reduction of torque transference between the key and the sleeve, the clearance closes such that the longitudinally extending portion of the stepped top edge contacts the longitudinally extending portion of the stepped bottom edge thereby maintaining rotation of the sleeve with the rotatable shaft. A centrifugal pump includes modules with a series of stepped, interlocked impellers.

22 Claims, 10 Drawing Sheets

(51) Int. Cl.

| | |
|---|---|
| ***F04D 29/047*** | (2006.01) |
| ***F04D 29/046*** | (2006.01) |
| ***F04D 29/041*** | (2006.01) |
| *F04D 1/06* | (2006.01) |

(52) U.S. Cl.
CPC ..... *F04D 29/0413* (2013.01); *F04D 29/0473* (2013.01); *F04D 1/06* (2013.01)

(58) Field of Classification Search
CPC . F04D 29/0473; F04D 29/0413; F04D 29/044
See application file for complete search history.

(56) References Cited

U.S. PATENT DOCUMENTS

| | | | | |
|---|---|---|---|---|
| 2,926,970 | A | | 3/1960 | Clark |
| 3,215,083 | A | | 11/1965 | Sarles et al. |
| 5,160,240 | A | | 11/1992 | Wilson |
| 5,209,577 | A | | 5/1993 | Swatek |
| 5,660,520 | A | * | 8/1997 | Scarsdale ..... E21B 43/128 415/104 |
| 5,722,812 | A | | 3/1998 | Knox et al. |
| 6,017,184 | A | | 1/2000 | Aguilar et al. |
| 6,068,444 | A | | 5/2000 | Sheth |
| 6,309,174 | B1 | | 10/2001 | Oklejas, Jr. et al. |
| 6,861,098 | B2 | | 3/2005 | Griffin et al. |
| 7,575,413 | B2 | | 8/2009 | Semple et al. |
| 7,909,090 | B2 | | 3/2011 | Reid |
| 8,277,124 | B2 | | 10/2012 | Sexton et al. |
| 8,400,035 | B2 | | 3/2013 | Watson |
| 8,684,679 | B2 | | 4/2014 | Tetzlaff et al. |
| 8,721,181 | B2 | | 5/2014 | Semple et al. |
| 8,894,350 | B2 | | 11/2014 | Brunner et al. |
| 9,017,043 | B2 | | 4/2015 | Parmeter et al. |
| 9,039,356 | B1 | | 5/2015 | Nowitzki et al. |
| 9,334,865 | B2 | | 5/2016 | Johnson et al. |
| 9,353,752 | B2 | | 5/2016 | Tetzlaff et al. |
| 9,353,753 | B2 | | 5/2016 | Wilson et al. |
| 9,500,202 | B1 | | 11/2016 | Davis et al. |
| 9,534,603 | B2 | | 1/2017 | St. John et al. |
| 9,702,232 | B2 | | 7/2017 | Fouillard et al. |
| 9,816,519 | B2 | | 11/2017 | Nowitzki et al. |
| 2003/0112703 | A1 | | 6/2003 | White |
| 2004/0057642 | A1 | | 3/2004 | New |
| 2013/0017075 | A1 | | 1/2013 | Orban et al. |
| 2014/0050570 | A1 | | 2/2014 | Jayaram et al. |
| 2015/0211547 | A1 | | 7/2015 | Nowitzki et al. |
| 2016/0115998 | A1 | | 4/2016 | Jayaram et al. |
| 2016/0123171 | A1 | | 5/2016 | Westphal et al. |
| 2016/0312789 | A1 | | 10/2016 | Moon |
| 2017/0058616 | A1 | | 3/2017 | Lunk et al. |
| 2018/0045209 | A1 | | 2/2018 | Nowitzki et al. |

OTHER PUBLICATIONS

International Searching Authority, "Written Opinion of the International Searching Authority" for PCT Application No. PCT/US2017/063350, dated Feb. 9, 2018, 5 pages.

* cited by examiner

TORQUE TRANSFER SYSTEM FOR CENTRIFUGAL PUMPS

CROSS REFERENCE TO RELATED APPLICATIONS

This application claims the benefit of U.S. Provisional Application No. 62/427,147 to Nowitzki et al., filed Nov. 28, 2016 and entitled "TORQUE TRANSFER SYSTEM FOR CENTRIFUGAL PUMPS," which is hereby incorporated by reference in its entirety.

BACKGROUND OF THE INVENTION

1. Field of the Invention

Embodiments of the invention described herein pertain to the field of electric submersible pumps. More particularly, but not by way of limitation, one or more embodiments of the invention enable a torque transfer system for centrifugal pumps.

2. Description of the Related Art

Fluid, such as gas, oil or water, is often located in underground formations. When pressure within the well is not enough to force fluid out of the well, the fluid must be pumped to the surface so that it can be collected, separated, refined, distributed and/or sold. Centrifugal pumps are typically used in electric submersible pump (ESP) applications for lifting well fluid to the surface. Centrifugal pumps impart energy to a fluid by accelerating the fluid through a rotating impeller paired with a non-rotating diffuser, together referred to as a "stage." In multistage centrifugal pumps, multiple stages of impeller and diffuser pairs may be used to further increase the pressure lift. The stages are stacked in series around the pump's shaft, with each successive impeller sitting on a diffuser of the previous stage. The pump shaft extends longitudinally through the center of the stacked stages. The shaft rotates, and the impeller is keyed to the shaft causing the impeller to rotate with the shaft.

Conventional ESP assemblies sometimes include bearing sets to carry radial and thrust forces acting on the pump during operation. The bearing set traditionally consists of a sleeve and bushing. The sleeve is keyed to the shaft and rotates with the shaft. The bushing is pressed into the diffuser around the sleeve and should not rotate.

The production fluid passing through the pump often contains solid abrasives, such as sand, rock, rock particles, soils or slurries that can cause damage to the pump components. In order to combat abrasion, the rotatable sleeve and bushing of the bearing set are conventionally made of tungsten carbide composite that includes a binder such as cobalt. The tungsten carbide cobalt composite is a hard, brittle material having a hardness value ranging from 90-100 HRA. The hardened sleeve and bushing is often referred to in the ESP industry as abrasion resistant trim, or "AR trim."

The key that secures the sleeve to the ESP shaft is conventionally a skinny, long rectangular strip about 36 inches in length and made of treated steel or an austenite alloy having a hardness of about 72 HRA (40-60 HRC). The key secures into keyways in both the sleeve and the shaft, allowing the sleeve to rotate with the shaft. Materials with a hardness of 40-60 HRC (72 HRA) are typically used for ESP keys because they are more ductile than harder, more brittle materials and therefore are simple to fabricate and permit the key to withstand shaft twist. Impellers are keyed to the ESP shaft in a similar fashion, with multiple keys stacked along the length of the shaft one above the next.

A problem that arises with conventional keys is fretting of the key. During operation of the ESP assembly, the shaft vibrates inside the sleeve. This vibration can occur in a variety of modes from axial to lateral to torsional, and results in the hard tungsten carbide sleeve repeatedly knocking and/or sliding against the softer key, leading to material loss on the key. In addition, in sandy environments, the sand passing through the pump abrades and induces destruction of the softer key material inside the sleeve. If the key loses 20% or more in thickness, this condition may cause asynchronous rotation between the sleeve and shaft. The asynchronous rotation causes the shaft to wear out, ultimately leading to shaft break. In addition, a worn key can cause the sleeve to "Spirograph" inside of the bushing, exacerbating fretting, and leading to shear failure. A thinned or broken key will not sufficiently transfer torque between the shaft and sleeve, causing failure of the bearing set, shaft break and shortening the operational life of the pump.

Some conventional approaches to transferring torque between an ESP shaft and an AR sleeve attribute fractures to angular deflections in the shaft, also knowns as "shaft twist." These approaches assume the shaft's angular deflections are imparted to the sleeve, and attempt to address the problem by eliminating the key from the sleeve entirely. In these "keyless" approaches, end rings or drive collars are keyed above or below the sleeve to indirectly turn the hard "keyless" sleeves. In some instances, the drive collar turns the sleeve using an angled tooth that engage a recess in the sleeve. The problem with these conventional designs is they lead to high stress concentration in the root of the remaining keyways, and provide little-to-no protection against abrasive damage to the keys turning the end rings, collars or impellers. Keys of the end rings and drive collar are themselves susceptible to shearing, particularly in abrasive environments, and if sheared the pumps entirely fail since the whole "keyless" system ceases to turn with the shaft. These designs also undesirably require additional components such as springs, end rings and drive collars that can be complex, expensive and cumbersome to install.

As is apparent from the above, currently available torque transfer systems for centrifugal pumps employed in ESPs suffer from many deficiencies. Therefore, there is a need for an improved torque transfer system for centrifugal pumps.

BRIEF SUMMARY OF THE INVENTION

One or more embodiments of the invention enable a torque transfer system for centrifugal pumps.

A torque transfer system for centrifugal pumps is described. An illustrative embodiment of a torque transfer system for a centrifugal pump includes a bearing sleeve above an impeller, the bearing sleeve and a hub of the impeller surrounding a rotatable shaft and coupled to the rotatable shaft by a key, the bearing sleeve having a stepped bottom edge, a top edge of the hub stepped inversely to the bottom edge of the bearing sleeve such that the top edge and the bottom edge interlock with a clearance between longitudinally extending portions of the interlocked edges, wherein upon reduction of torque transference between the key and the bearing sleeve, the clearance closes such that the longitudinally extending portion of the stepped top edge contacts the longitudinally extending portion of the stepped bottom edge thereby maintaining rotation of the bearing sleeve with the rotatable shaft. In some embodiments, the longitudinally extending portion of the stepped bottom edge of the bearing sleeve defines a driving surface of the bearing sleeve, the driving surface below a bearing surface of the bearing sleeve, and further including a non-rotatable bushing around the bearing surface. In certain embodiments, the bearing sleeve includes a flange extending radially outward around the top of the sleeve over the bushing, wherein the flange carries thrust of the centrifugal pump. In some embodiments, the key is seated in a keyway that extends along an inner diameter of the bearing surface of the sleeve, along an inner diameter of the driving surface of the sleeve, and continues from the inner diameter of the driving surface of the sleeve along an inner diameter of a hub surface. In certain embodiments, the torque transfer system further includes a standoff sleeve above the bearing sleeve, the standoff sleeve including a stepped top edge interlocked with a bottom end of a second hub of a second impeller above the standoff sleeve. In some embodiments, the reduction of torque transference causes asynchronous rotation between the bearing sleeve and the rotatable shaft to close the clearance.

An illustrative embodiment of a centrifugal pump includes a module including a rotatable shaft, a series of impellers stacked on the rotatable shaft, each impeller including a hub secured to the rotatable shaft by a key, the series of impellers including an uppermost impeller and a lowermost impeller, a flange sleeve keyed to the rotatable shaft above the uppermost impeller, a standoff sleeve keyed to the rotatable shaft below the lowermost impeller, and each impeller of the series of impellers including a stepped edge on a top end of the hub and a stepped edge on a bottom end of the hub, wherein ends of opposing hubs are inversely stepped so as to interlock with a first clearance between longitudinal portions of the opposing stepped edges, the top end of the hub of the uppermost impeller interlocked with a stepped bottom edge of the flange sleeve with a second clearance between longitudinal portions of the opposing stepped edges, and the bottom end of the hub of the lowermost impeller interlocked with a stepped upper edge of the standoff sleeve with a third clearance between longitudinal portions of the opposing stepped edges. In some embodiments, a plurality of the modules are stacked on the rotatable shaft with a first module standoff sleeve above a second module flange sleeve, wherein each of a bottom of the first module standoff sleeve and a top of the second module flange sleeve are uniform in longitudinal length. In certain embodiments, there are between two and four impellers in the series of impellers. In some embodiments, upon reduction of torque transference of the key, the first, second and third clearances close such that contact between the longitudinal portions of the stepped opposing edges maintains rotation of the flange sleeve, the standoff sleeve and the series of impellers with the rotatable shaft. In certain embodiments, the flange sleeve includes a bearing surface and a driving surface, wherein the driving surface includes the longitudinal portion, and further including a non-rotatable bushing surrounding the bearing surface.

An illustrative embodiment of a torque transfer system for a centrifugal pump includes a rotatable shaft extending longitudinally through a hub of an impeller, the hub coupled to the rotatable shaft by a key, a sleeve secured to the rotatable shaft by the key, the sleeve above the impeller and including a bearing surface extending circumferentially around the rotatable shaft, a driving surface, the driving surface between the bearing surface and a top portion of the hub, and the driving surface extending partially around the rotatable shaft to form a stepped bottom edge of the sleeve, the top portion of the hub stepped inversely to the bottom edge of the sleeve with a clearance between longitudinally extending portions of the top portion of the hub and the bottom edge of the sleeve, wherein upon reduction of torque transference between the key and the sleeve, the clearance closes such that contact between the longitudinally extending portions maintains rotation of the sleeve with the rotatable shaft. In some embodiments, the key extends across an inner diameter of the radial bearing surface and the driving surface of the sleeve. In certain embodiments, the sleeve includes a radially extending flange around a top of the bearing surface. In some embodiments, the torque transfer system further includes a bushing extending around the bearing surface.

An illustrative embodiment of a centrifugal pump includes a rotatable shaft, a sleeve extending axially below a radially extending flange, the sleeve keyed to the rotatable shaft and including a bearing surface extending circumferentially around the rotatable shaft a first axial length below the flange, a driving surface extending from and below the bearing surface partially around the rotatable shaft a second axial length below the bearing surface, the second axial length defined by a pair of longitudinally extending edges, and wherein a bottom edge of the bearing surface, a bottom edge of the driving surface and the pair of longitudinally extending edges together form a stepped sleeve edge, an impeller around the rotatable shaft below the sleeve, the impeller including a hub, a top end of the hub including a hub edge stepped inversely to the sleeve edge, and the hub edge and the stepped sleeve edge interlocked. In some embodiments, the bearing surface and the driving surface of the sleeve are coupled to the rotatable shaft by a key. In certain embodiments, upon shearing of the key, contact between the one of the pair of longitudinally extending edges and a longitudinal portion of the hub edge maintain rotation of the sleeve with the rotatable shaft. In some embodiments, the centrifugal pump further includes a non-rotatable bushing extending around the bearing surface of the sleeve. In some embodiments, the bushing has a length substantially equal to the first axial length. In certain embodiments, a bottom end of the hub is stepped inversely to a top end of a second hub of a second impeller keyed to the rotatable shaft. In some embodiments, contact between the bottom end of the hub and the top end of the second hub transfers torque between the impeller and the second impeller.

In further embodiments, features from specific embodiments may be combined with features from other embodiments. For example, features from one embodiment may be combined with features from any of the other embodiments. In further embodiments, additional features may be added to the specific embodiments described herein.

BRIEF DESCRIPTION OF THE DRAWINGS

Advantages of the present invention may become apparent to those skilled in the art with the benefit of the following detailed description and upon reference to the accompanying drawings in which.

Figure 1:
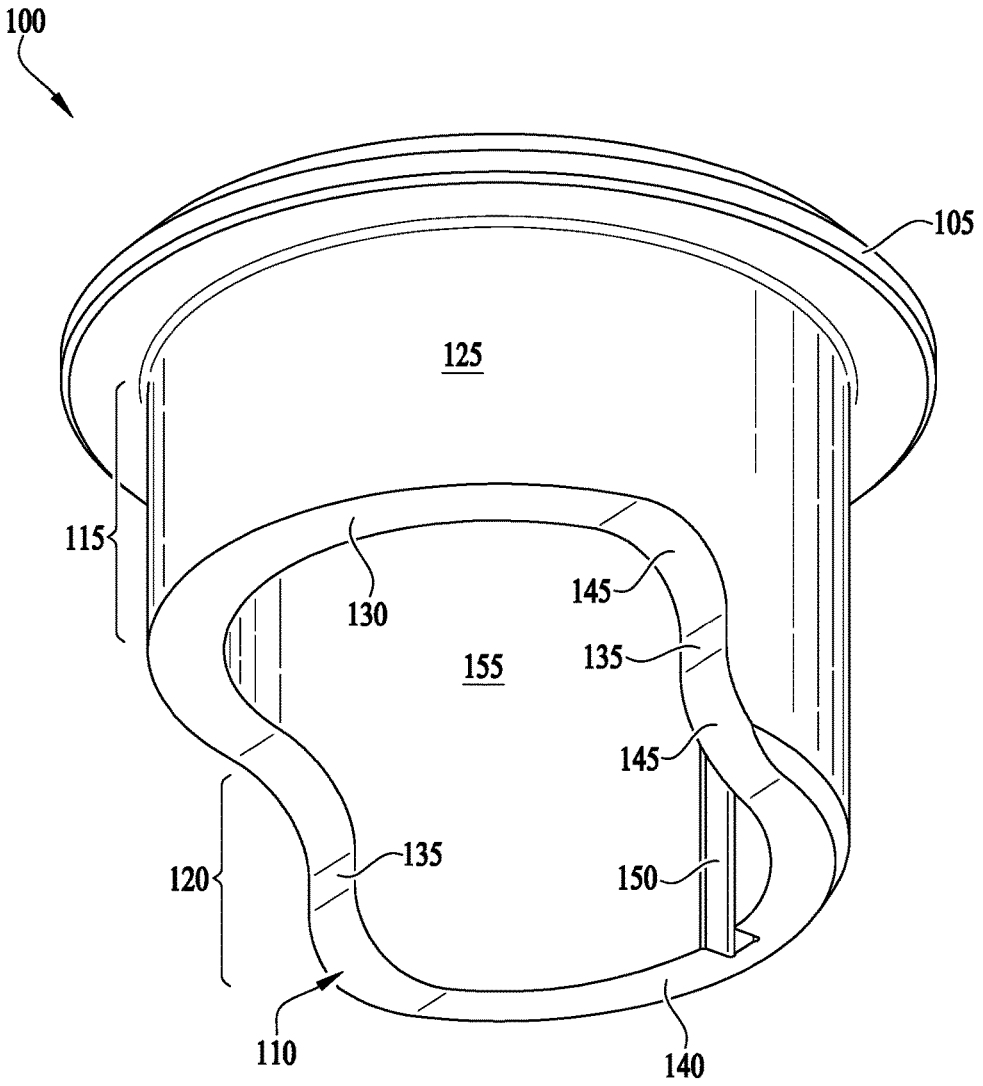
FIG. 1 is a perspective view of a bearing sleeve of an illustrative embodiment.

While the invention is susceptible to various modifications and alternative forms, specific embodiments thereof are shown by way of example in the drawings and may herein be described in detail. The drawings may not be to scale. It should be understood, however, that the embodiments described herein and shown in the drawings are not intended to limit the invention to the particular form disclosed, but on the contrary, the intention is to cover all modifications, equivalents and alternatives falling within the scope of the present invention as defined by the appended claims.

DETAILED DESCRIPTION

A torque transfer system for centrifugal pumps is described. In the following exemplary description, numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

As used in this specification and the appended claims, the singular forms "a", "an" and "the" include plural referents unless the context clearly dictates otherwise. Thus, for example, reference to a "key" includes one or more keys.

"Coupled" refers to either a direct connection or an indirect connection (e.g., at least one intervening connection) between one or more objects or components. The phrase "directly attached" means a direct connection between objects or components.

As used herein, the term "outer," "outside" or "outward" means the radial direction away from the center of the shaft of the electric submersible pump (ESP) and/or the opening of a component through which the shaft would extend.

As used herein, the term "inner", "inside" or "inward" means the radial direction toward the center of the shaft of the ESP and/or the opening of a component through which the shaft would extend.

As used herein the terms "axial", "axially", "longitudinal" and "longitudinally" refer interchangeably to the direction extending along the length of the shaft of an ESP assembly component such as an ESP intake, multi-stage centrifugal pump, seal section, gas separator or charge pump.

As used in this specification and the appended claims, "downstream" or "upwards" refer interchangeably to the longitudinal direction substantially with the principal flow of lifted fluid when the pump assembly is in operation. By way of example but not limitation, in a vertical downhole ESP assembly, the downstream direction may be towards the surface of the well. The "top" of an element refers to the downstream-most side of the element, without regard to whether the element is oriented horizontally, vertically or extends through a radius. "Above" refers to an element located further downstream than the element to which it is compared.

As used in this specification and the appended claims, "upstream" or "downwards" refer interchangeably to the longitudinal direction substantially opposite the principal flow of lifted fluid when the pump assembly is in operation. By way of example but not limitation, in a vertical downhole ESP assembly, the upstream direction may be opposite the surface of the well. The "bottom" of an element refers to the upstream-most side of the element, without regard to whether the element is oriented horizontally, vertically or extends through a radius. "Below" refers to an element located further upstream than the element to which it is compared.

As used herein, "sand" and "sandy" are used liberally to refer to any solid or slurry, such as proppant, sand, dirt, rock and/or abrasive particles, contained in lifted well fluid and passing through the ESP assembly and/or centrifugal pump of illustrative embodiments.

For ease of description, the illustrative embodiments described herein are described in terms of an ESP assembly. However, the torque transfer system of illustrative embodiments may be applied to any centrifugal pump having rotatable components keyed to a drive shaft, and may be particularly useful where the torque transferring key is at risk of shearing, such as in sandy environments and/or where abrasion resistant trim (AR trim) is employed. In addition, illustrative embodiments may be employed in any component of an ESP assembly that employs AR trim, stages, modules and/or components that rotate by key to shaft, such as a gas separator, charge pump and/or primary multistage centrifugal pump.

Illustrative embodiments may provide a secondary torque transfer system for centrifugal pumps that employ one or more keys as the primary mechanism to transfer torque between the pump's drive shaft and the pump's rotatable components, in order to turn the rotatable components during pump operation. Illustrative embodiments may maintain constant rotation of a flanged sleeve, impeller and/or standoff sleeve in the instance a key shears, wears, frets, breaks or otherwise fails to transfer torque and/or provides reduced torque transference between the drive shaft on the one hand, and the sleeve, impeller and/or standoff sleeve on the other hand. The portion of the key in contact with the hard bearing sleeve may in some instances be most likely to break due to fretting, although illustrative embodiments may provide improved operation with respect to any key that may shear or fret within a stage and/or module of illustrative embodiments such as the key of a standoff sleeve and/or impeller. Illustrative embodiments may reduce the instance of shaft break, reduce the instance of bearing failure, improve handling of shaft twist and/or may increase the operational life of an ESP pump in sandy environments without the need for any new components added into the pump.

Illustrative embodiments may include stepped edges of tubular, rotatable pump components such as a radial support sleeve, flanged sleeve, impeller hub and/or standoff sleeve. The edges of each sleeve and/or hub may be stepped to provide two sections of differing axial length on a single component, such that each rotatable component has a circumferential portion shorter in longitudinal length and a circumferential portion longer in longitudinal length. A longitudinally extending edge may connect the long and short circumferential portions of the component. Edges of opposing adjacent rotatable components may be inversely shaped and/or inversely notched to one another such that a long portion of a first component mates with a short portion of an adjacent component and/or adjacent components interlock, overlap in length along the shaft, and/or interconnect. A clearance may extend between opposing longitudinally extending edges when the key functions to transfer torque. In the event of key failure or loss of strength, the clearance between opposing longitudinal edges may close, and contact between the steps may permit constant rotation of the rotatable components throughout the length of the broken or damaged key. In the event of minor fretting of the key, the stepped edges may relieve the fretted key of the primary torque transfer function.

Illustrative embodiments may provide a secondary torque transfer mechanism in systems employing keys as the primary torque transfer mechanism. Illustrative embodiments may provide continued and synchronous rotation of an entire pump module regardless of the particular location of a broken or weakened key. Illustrative embodiments may increase the engagement area between a sleeve and a key without increasing shaft twist stress, by redistributing stress along the sleeve.

FIG. 1 illustrates an exemplary sleeve of an illustrative embodiment. Bearing sleeve 100 may be a flanged sleeve, providing both thrust and radial support, and include flange 105. Flange 105 may extend radially outward from and around axially extending, tubular portion 125. In some embodiments bearing sleeve 100 may be a radial support sleeve and flange 105 may be omitted. Tubular portion 125 may receive shaft 300 (shown in FIG. 3). Inner diameter 155 of bearing sleeve 100 and/or tubular portion 125 may include keyway 150 for seating of key 305 (shown in FIG. 3). Bearing sleeve 100 may be abrasion resistant trim (AR Trim) and be made of a hard material such as a tungsten carbide composite, tungsten carbide, silicon carbide, titanium carbide or another similar carbide material.

Bottom edge 110 of bearing sleeve 100 may be stepped forming tubular portion 125 with two distinct lengths and/or a longer side and a shorter side. As shown in FIG. 1, sleeve bottom edge 110 may be stepped and/or waterfall shaped, similar in appearance to a high-low hem. Bearing sleeve 100 may include bearing surface 115 and driving surface 120. Driving surface 120 may be a longitudinal extension from bearing surface 115, adjacently below only a portion of bearing surface 115. Bushing 400 (shown in FIG. 4) paired with bearing sleeve 100 may surround bearing surface 115, but not driving surface 120, which driving surface 120 may extend below bushing 400. Bearing surface 115 may extend 360° around bearing sleeve 100, whereas driving surface 120 may extend only partially around the circumference of bearing sleeve 100, for example, 90°, 180° or 240° around bearing sleeve 100 to create the stepped and/or waterfall feature of bottom edge 110, similar in appearance to a mullet haircut. Stepped sleeve bottom edge 110 may reduce the effect of shaft twist by keeping short a portion of the length of sleeve 100 while simultaneously increasing the length of key 300 engagement with sleeve 100.

Figure 4:
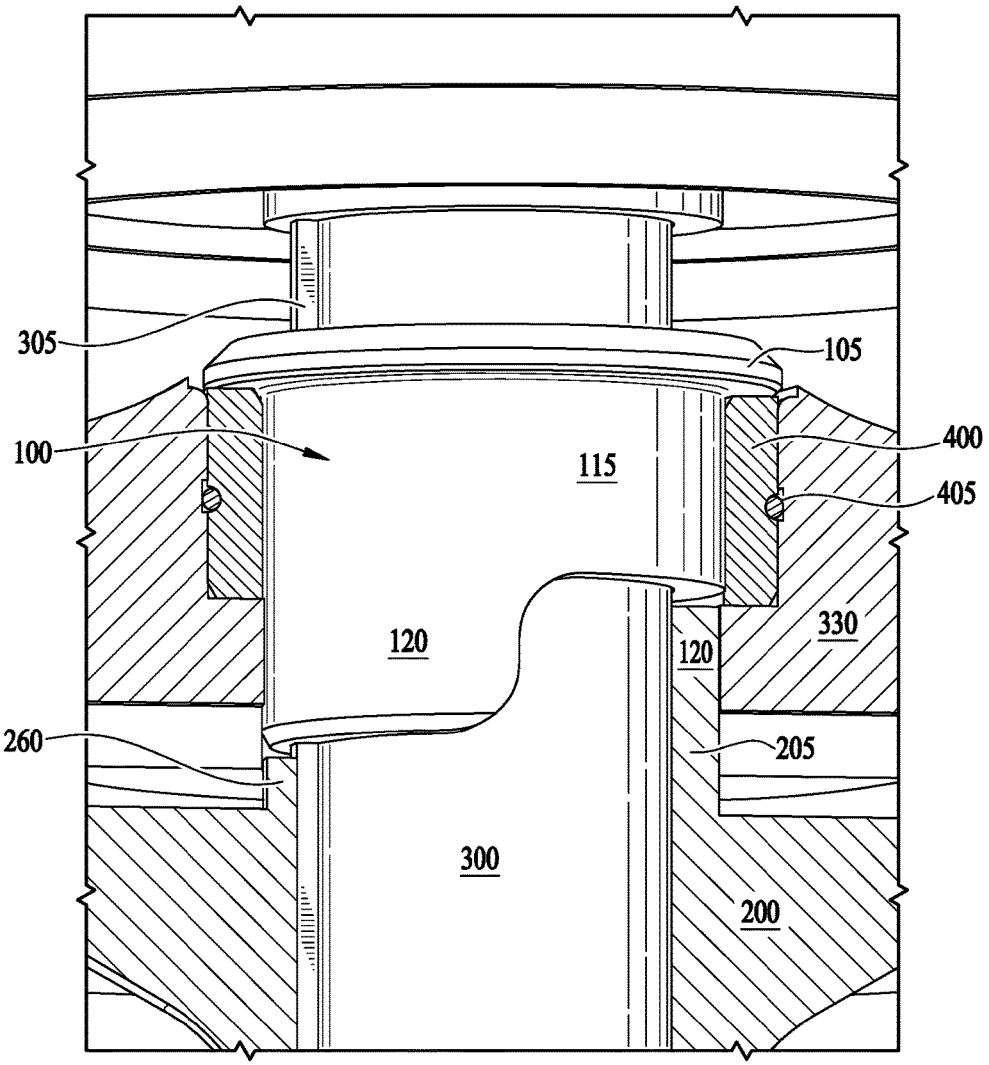
FIG. 4 is a perspective view of a bearing set of an illustrative embodiment.

Turning to FIG. 4, bushing 400 may surround bearing surface 115 of bearing sleeve 100. Bushing 400 may be press-fit (friction fit) into the wall of diffuser 330 or may be a compliant bearing with elastomeric ring 405 between bushing 400 and diffuser 330 wall. Together, bushing 400 and bearing sleeve 100 may form a hydrodynamic bearing set as bearing sleeve 100 rotates inside non-rotating bushing 400.

Returning to FIG. 1, sleeve bottom edge 110 may be formed by and/or include bearing surface bottom edge 130 and driving surface bottom edge 140, connected and/or coupled by a pair of longitudinal edges 135. Bearing surface bottom edge 130 and driving surface bottom edge 140 may each be a portion of a circle. Together, driving surface bottom edge 140 and bearing surface bottom edge 130 may circumvent 360° or about 360°, forming a full circle or about a full circle around bearing sleeve 100. Longitudinal edges 135 may connect and/or couple bearing surface bottom edge 130 and driving surface bottom edge 140. Longitudinal edges 135 may be axially extending, or extend about axially in a longitudinal direction to form a step between bearing surface bottom edge 130 and driving surface bottom edge 140, similarly to a step of a staircase. Intersections 145 between longitudinal edges 135 on the one hand and driving surface bottom edge 140 and/or bearing surface bottom edge 130 on the other hand, may be rounded, curved and/or smooth. Bearing sleeve 100 may be cast in the desired stepped shape and/or may be cast to match the longest length of tubular portion 125, and then ground to create stepped sleeve bottom edge 110.

Keyway 150 may extend on inner diameter 155 of bearing sleeve 100, along the portion of bearing sleeve 100 including driving surface 120. Including keyway 150 on the longer side and/or longest side of tubular portion 125 may increase the area of engagement between mated key 305 and rotatable bearing sleeve 100. The stepped feature of sleeve bottom edge 110 may allow the area of engagement between key 305 and inner diameter 155 of sleeve 100 to be increased without increasing or without substantially increasing stress from shaft 300 twist, since bearing surface bottom edge 130 may remain shorter than driving surface bottom edge 140. In an illustrative example, bearing surface of tubular portion may be 0.465 inches in axial length (e.g., the length from flange 105 to bearing surface bottom edge 130), and longitudinal edges 135 may be about 0.300 inches in length and/or driving surface bottom edge 140 may be 0.300 inches lower than bearing surface bottom edge 130. In this example, the longest side of tubular portion 125 may be about 0.765 inches long and include keyway 150, and the short side of tubular portion 125 may be 0.465 inches long. Other lengths of tubular portion 125 may similarly be employed with driving surface 120 of sleeve 100 being 50%, 65%, 75% longer, or another similar length increase compared to bearing surface 115. Stepped sleeve 100 shape formed by stepped bottom edge 110 may alter stress distribution along sleeve 100, which may improve shaft twist handling capability.

Figure 2:
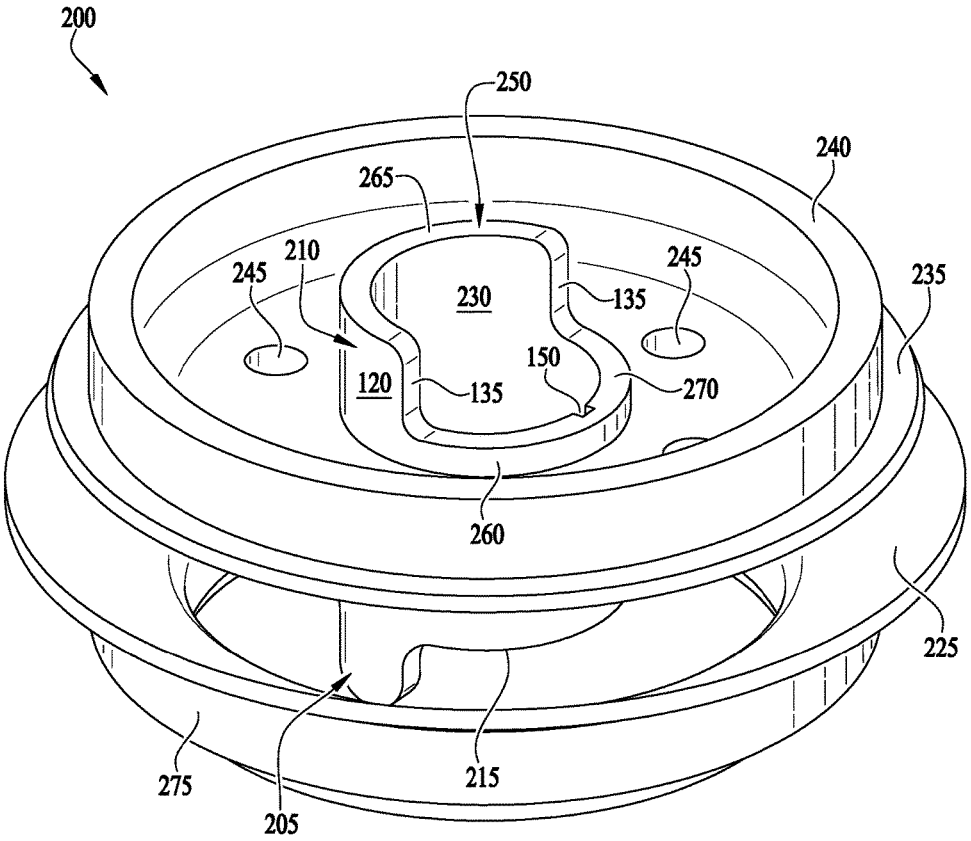
FIG. 2 is perspective view of an impeller of an illustrative embodiment.

FIG. 2 illustrates an impeller of an illustrative embodiment. Impeller 200 may include hub 205, lower shroud 225 and upper shroud 235. Vanes 310 (shown in FIG. 3) may extend between hub 205 and impeller shrouds 225, 235. Balance ring 240 may extend axially around the periphery of upper shroud 235, and skirt 275 may extend downwards around and from lower shroud 225. Balance holes 245 may extend through upper shroud 235. Hub 205 may tubularly surround shaft 300, and include keyway 150 on hub inner diameter 230, which keyway 150 may mate with key 305. Hub 205 may include hub top end 210 and hub bottom end 215. One or both of hub top end 210 and hub bottom end 215 may include stepped hub edge 250 similar to bottom edge 110 of bearing sleeve 100. As shown in FIG. 2, hub top end 210 and hub bottom end 215 have a hi-low, stepped, and/or waterfall shaped stepped hub edge 250. Stepped hub edge 250 on hub top end 210 of impeller 200 may be inversely shaped to bottom edge 110 of bearing sleeve 100, such that when bearing sleeve 100 is stacked on a rotatable shaft above impeller 200, bottom edge 110 of bearing sleeve 100 and stepped hub edge 250 on hub top end 210 are inversely shaped to one another, oppose one another, interconnect, overlap in length along shaft 300 and/or interlock. Similarly, if a second impeller 200 is below a first impeller 200, stepped hub edge 250 on hub bottom end 215 of the first impeller 200 may interlock with a stepped hub edge 250 on the hub top end 210 of the second impeller 200 located below the first.

Stepped hub edge 250 may include driving surface 120 that may be a longitudinal extension from hub surface 260, where driving surface 120 may extend only partially around the circumference of shaft 300 and/or hub 205. Longitudinal edges 135 may connect and/or couple driving surface top edge 265 to hub surface top edge 270. In some embodiments, driving surface 120 may extend about the same height as balance ring 240 such that driving surface top edge 265 is aligned with the top of balance ring 240. Keyway 150 of hub may extend along inner diameter 230 of hub surface 260 and/or driving surface 120. As shown in FIG. 4, driving surface 120 of impeller 200 may extend on the opposite side of hub 205 from keyway 150 of impeller 200. In this example, if impeller 200 is directly below sleeve 100, key 305 may extend along inner diameter 155 of both bearing surface 115 and driving surface 120 of bearing sleeve 100, and then continue along hub inner diameter 230 of hub surface 260, but not driving surface 120 of impeller 200.

Figure 3:
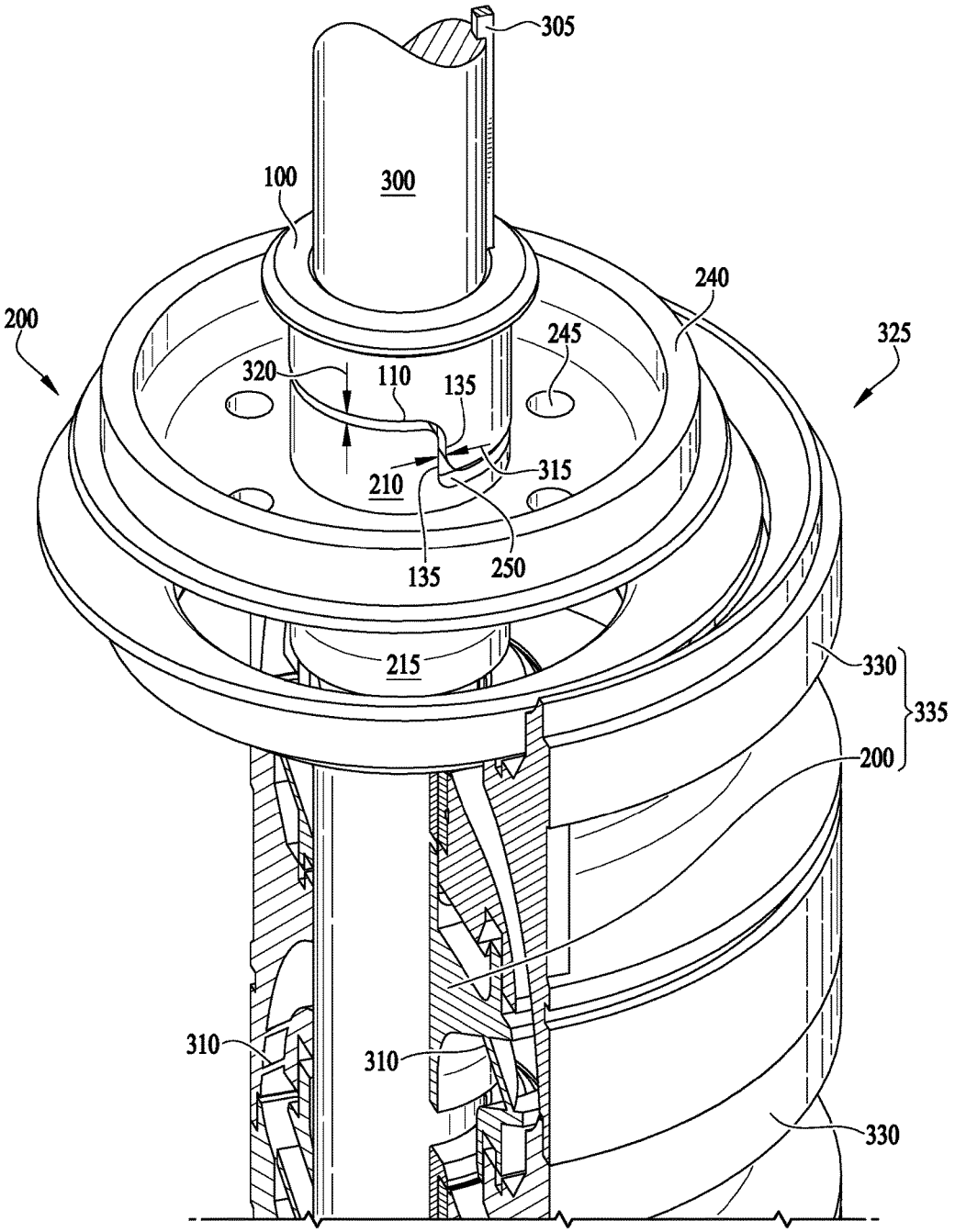
FIG. 3 is a perspective view of a centrifugal pump of an illustrative embodiment with part cutaway.

FIG. 3 illustrates interlocking and/or mating between bearing sleeve 100 and hub 205 in multistage centrifugal pump 325 of an illustrative embodiment. In FIG. 3, stepped hub edge 250 on hub top end 210 is interlocked and/or mated with bottom edge 110 of bearing sleeve 100. When key 305 functions to transfer torque without reduction of torque transference and/or strength, clearance 315 may extend between longitudinal edge 135 of bottom edge 110 of sleeve 100 and the opposing longitudinal edge 135 of stepped hub edge 250. In an illustrative embodiment, clearance may be 0.001-0.0625 inches in width. Clearance 315 may simplify assembly of module 600 (shown in FIG. 6) and tolerance stack up. In some embodiments, where tolerance control is substantially perfect, clearance 315 may not be necessary and/or may equal zero, and longitudinal edges 135 may be engaged and/or contact one another at assembly. Stepped hub edge 250 may be machined and/or shaped inversely to the shape of sleeve bottom edge 110 and/or the stepped edge directly above stepped hub edge 250. In some embodiments, hub bottom end 215 may similarly include stepped hub edge 250 that may interconnect and/or interlock with hub top end 210 of an adjacent impeller 200 stacked below hub bottom end 215. A space 320 may also extend between circumferential portions of sleeve bottom edge 110 and stepped hub edge 250, such that hub top end 210 and bearing sleeve 100 do not touch each other, depending on the compression of centrifugal pump 325.

In FIG. 3, bearing sleeve 100 is shown interlocked (interconnected) with hub 205 of impeller 200 with clearance 315 between longitudinal edge 135 of stepped hub edge 250 and longitudinal edge 135 of bottom edge 110 of bearing sleeve 100. As shown in FIG. 3, hub 205 and bearing sleeve 100 fit, mate and/or interlock together although hub top end 210 and sleeve bottom edge 110 may not touch. FIG. 3 illustrates edge positioning when key 305 is not in a weakened or sheared condition. Impeller 200 may be paired with non-rotating diffuser 330 and/or carrier to form centrifugal pump stage 335. Rotatable shaft 300 may extend centrally and longitudinally through bearing sleeve 100 and hub 205 of impeller 200 that may each rotate with shaft 300. Key 305, seated in keyways 150 on the inner diameters of bearing sleeve 100 and hub 205, may provide primary rotation for bearing sleeve 100 and/or impeller 200, so long as key 305 remains unweakened.

Figure 5A:
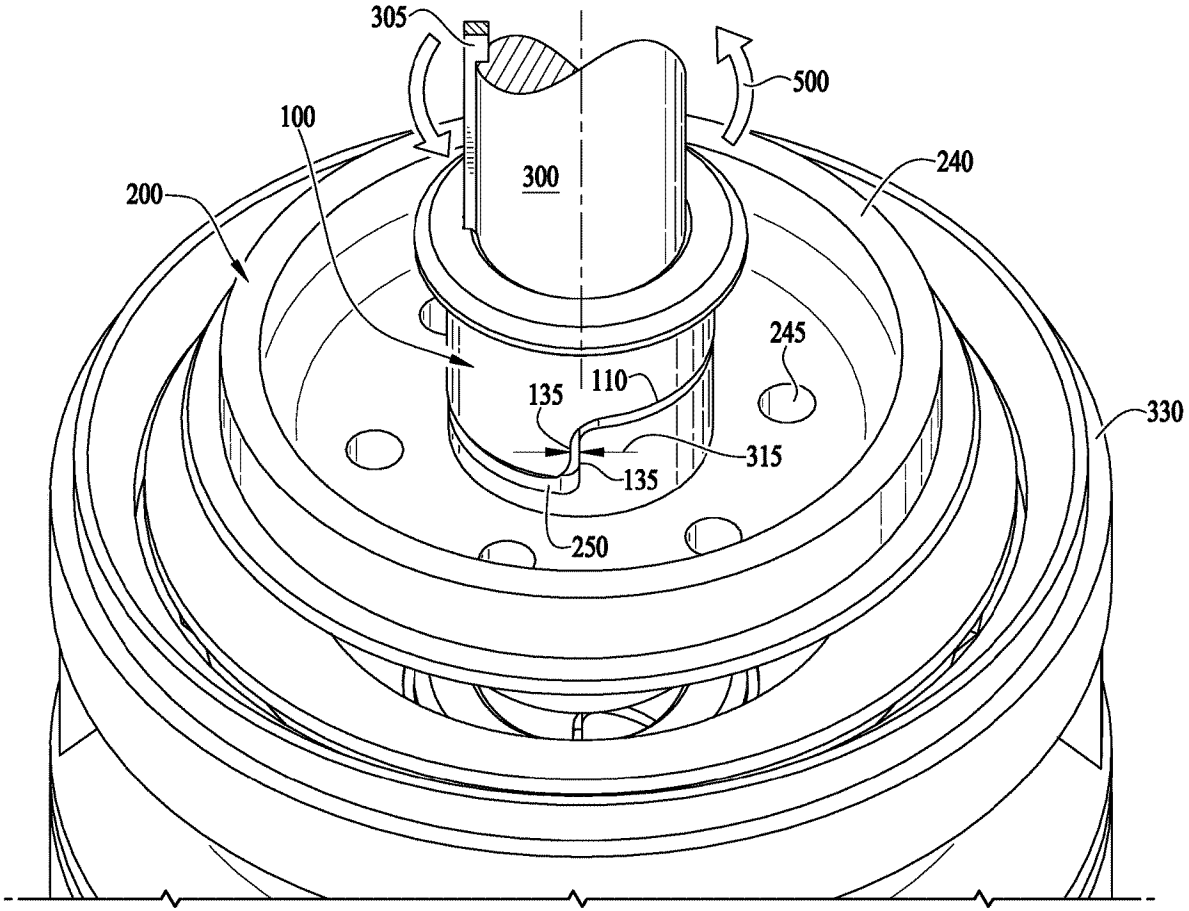
FIG. 5A is a perspective view of a torque transfer system of an illustrative embodiment having a clearance between interlocked opposing edges.

FIG. 5A illustrates an interlocked position of bearing sleeve 100 and hub 205 when key 305 provides primary torque transference from shaft 300 to bearing sleeve 100 and from shaft 300 to impeller 200. FIG. 5A shows an exemplary position of bottom edge 110 of bearing sleeve 100 interlocked with stepped hub edge 250 when intact key 305 transfers torque between shaft 300 and bearing sleeve 100 and/or impeller 200. As shown in FIG. 5A, shaft 300 is rotating in clockwise direction 500 and clearance 315 is present between adjacent and/or opposing longitudinal edges 135 of bearing sleeve 100 and impeller 200. Edges 110, 250 overlap along shaft 300, such that a portion of hub 205 extends past a portion of sleeve 100 along shaft 300 and vice versa. In the instance that the torque transferring key 305 frets, shears, breaks or wears, for example wears 20% or more of its thickness, the keyways 150 of bearing sleeve 100 and impeller 200 may cease to remain parallel to one another due to asynchronous rotation between shaft 300 and bearing sleeve 100, causing clearance 315 to close and longitudinal portions 135 of sleeve bottom edge 110 and stepped hub edge 250 to contact one another.

Figure 5B:
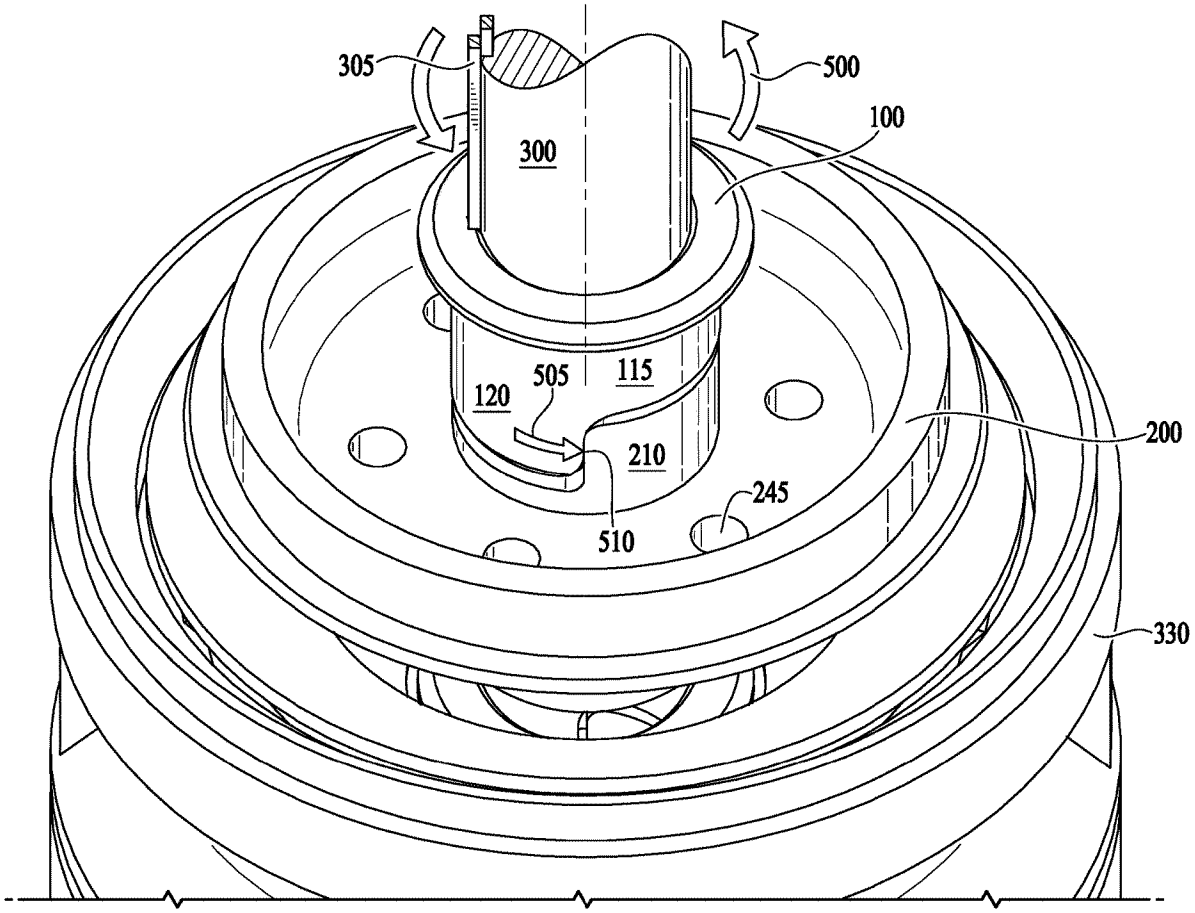
FIG. 5B is a perspective view of a torque transfer system of an illustrative embodiment with a closed clearance between interlocked opposing edges.

FIG. 5B illustrates an interlocked position of bearing sleeve 100 and hub 205 when key 305 loses strength and/or abrades so as to provide reduced torque transference and/or a loss of torque transference. As shown in FIG. 5B, rotation of shaft 300 in clockwise direction 500 while key 305 is worn and/or fretted, may cause asynchronous rotation illustrated by arrow 505 and clearance 315 to close. When clearance 315 closes, adjacent longitudinal edges 135 of sleeve 100 and impeller 200 may contact one another. Contact 510 between bearing sleeve 100 and impeller 200 may allow bearing sleeve 100 and impeller 200 to once again and/or continue to rotate at the same rate, despite wear, shearing or other failure of key 305. For example, if bearing sleeve 100, made of a hard material such as a tungsten carbide composite, frets through key 305, then clearance 315 may close due to misalignment between the keyways 150 of bearing sleeve 100 and impeller 200 and/or asynchronous rotation between bearing sleeve 100 and shaft 300. In another example, if key 305 extending along impeller hub 205 abrades and weakens, clearance 315 on the opposite side of sleeve 100 and hub 205 may similarly close. In such instances, longitudinal edges 135 of stepped hub edge 250 on hub top end 210 and bottom edge 110 of bearing sleeve 100 may move circumferentially to contact one another. Once the edges 250, 110 are in contact 510, then impeller 200 may rotate bearing sleeve 100 with impeller 200 or bearing sleeve 100 may rotate impeller 200 with bearing sleeve 100, at the same rpm, through contact area 510. Torque may thus be transferred from impeller 200 to sleeve by virtue of contact area 510 along the length or a portion of the length of opposing longitudinally extending edges 135. Should key 205 shear at impeller 200, the driving surface 120 of bearing sleeve 100 may turn impeller 200, for example driven by an intact portion of the same key 205 or by one or more unweakened adjacent keys 205.

Figure 6:
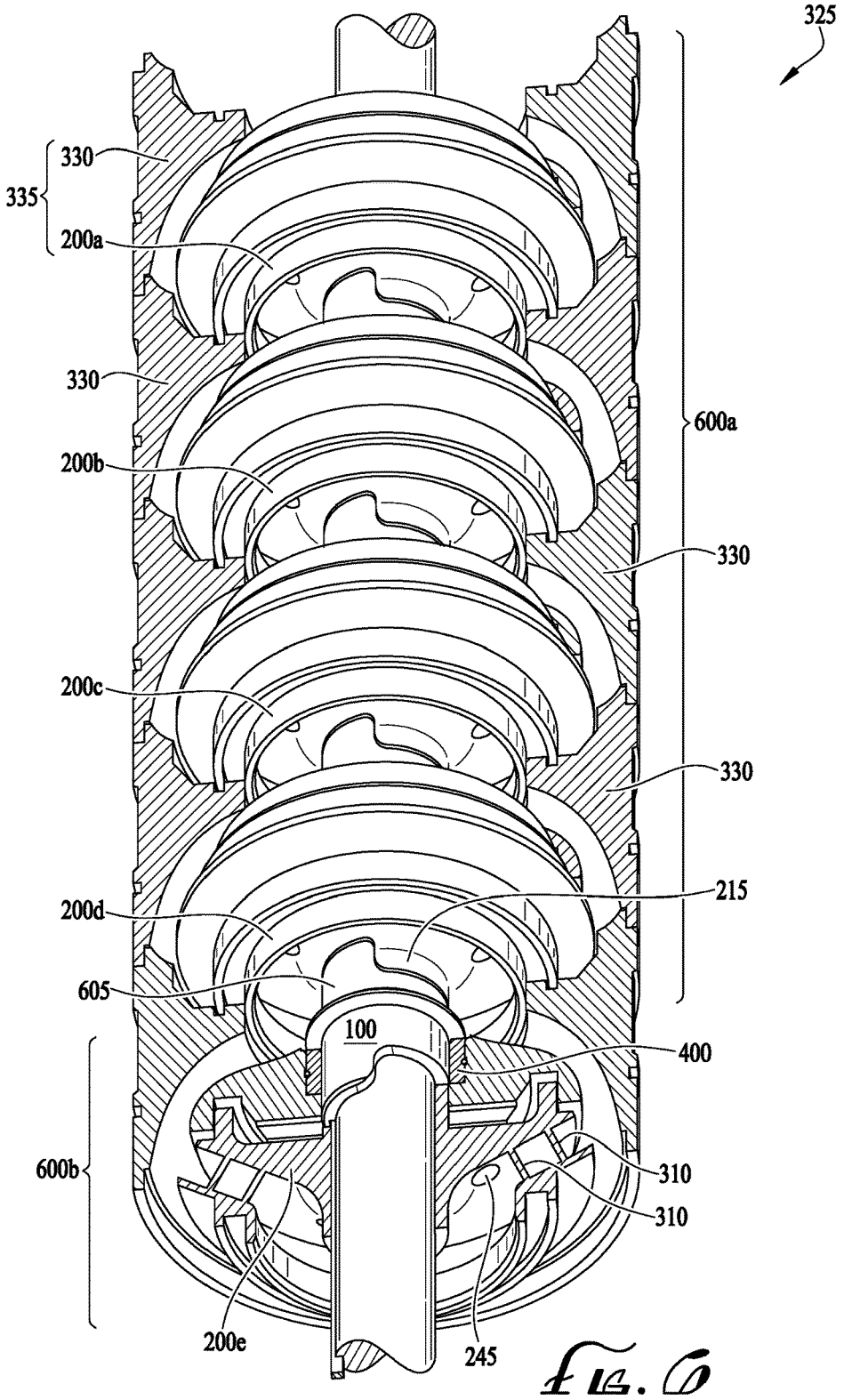
FIG. 6 is a perspective view of a module of an illustrative embodiment.

FIG. 6 illustrates a centrifugal pump module of an illustrative embodiment. In FIG. 6, the bottom of first module

600*a* and the top of second module 600*b* is shown. In the embodiment shown in FIG. 6, each module 600 includes a series of four impellers 200, with bearing sleeve 100 above the series of impellers 200, and standoff sleeve 605 below the series of impellers 200. As described herein, bearing sleeve 100 may be a flanged sleeve and/or a radial support sleeve. Standoff sleeve 605 may support impeller 200, and the length of standoff sleeve 605 may determine the operating height of impeller 200. Standoff sleeve 605 may be a Ni-resist austenitic cast iron alloy or stainless steel if shimmed. An exemplary module 600 of an illustrative embodiment may include, from top to bottom, bearing sleeve 100 at the top of module 600, a series of four stacked impellers 200*a*-200*d*, and standoff sleeve 605 at the bottom of module 600, each of which may include keyways 150 extending longitudinally along their inner diameters. A continuous keyway 150 may extend along shaft 300 the entire length of module 600. One or more keys 300 may mate to the continuous keyways 150 along the entire length of module 600 and along each rotatable component included within module 600.

Adjacent components within module 600 may include interlocked and/or interconnected opposing stepped edges that are shaped inversely to one another with clearance 315 between opposing longitudinal edges 135 when key 305 maintains torque transference capability, and which clearance 315 closes upon weakening and/or failure of the torque transmitting key 305. In some embodiments, each bearing sleeve 100, impeller 200 and/or standoff sleeve 605 within a module 600 may be interconnected, with a break in the connections (no interconnection) between adjacent modules 600. Thus, for example in module 600*a* shown in FIG. 6, impeller 200*a* may be interlocked with impeller 200*b* below and with a bearing sleeve 100 above (the bearing sleeve 100 of module 600*a* is not shown); impeller 200*b* may be interlocked with impeller 200*c* below and with impeller 200*a* above; impeller 200*c* may be interlocked with impeller 200*b* above and impeller 200*d* below; impeller 200*d* may be interlocked with standoff sleeve 605 below and with impeller 200*c* above; and the bottom of standoff sleeve 605 of module 600*a* is not interlocked with the top of bearing sleeve 100 of module 600*b*. In module 600*b*, bearing sleeve 100 is interlocked with impeller 200*e* below the bearing sleeve 100 of module 600*b*. Any number of impellers 200 may be included in module 600, however the inventors have observed that upon failure of one or more of the torque transmitting keys 305 of module 600, the interlocked connections of illustrative embodiments may not be strong enough to hold and transfer torque at the desired rpm if module 600 includes too many impellers 200. Thus, it is currently preferred that each module 600 include between two and five impellers 200.

Figure 7A:
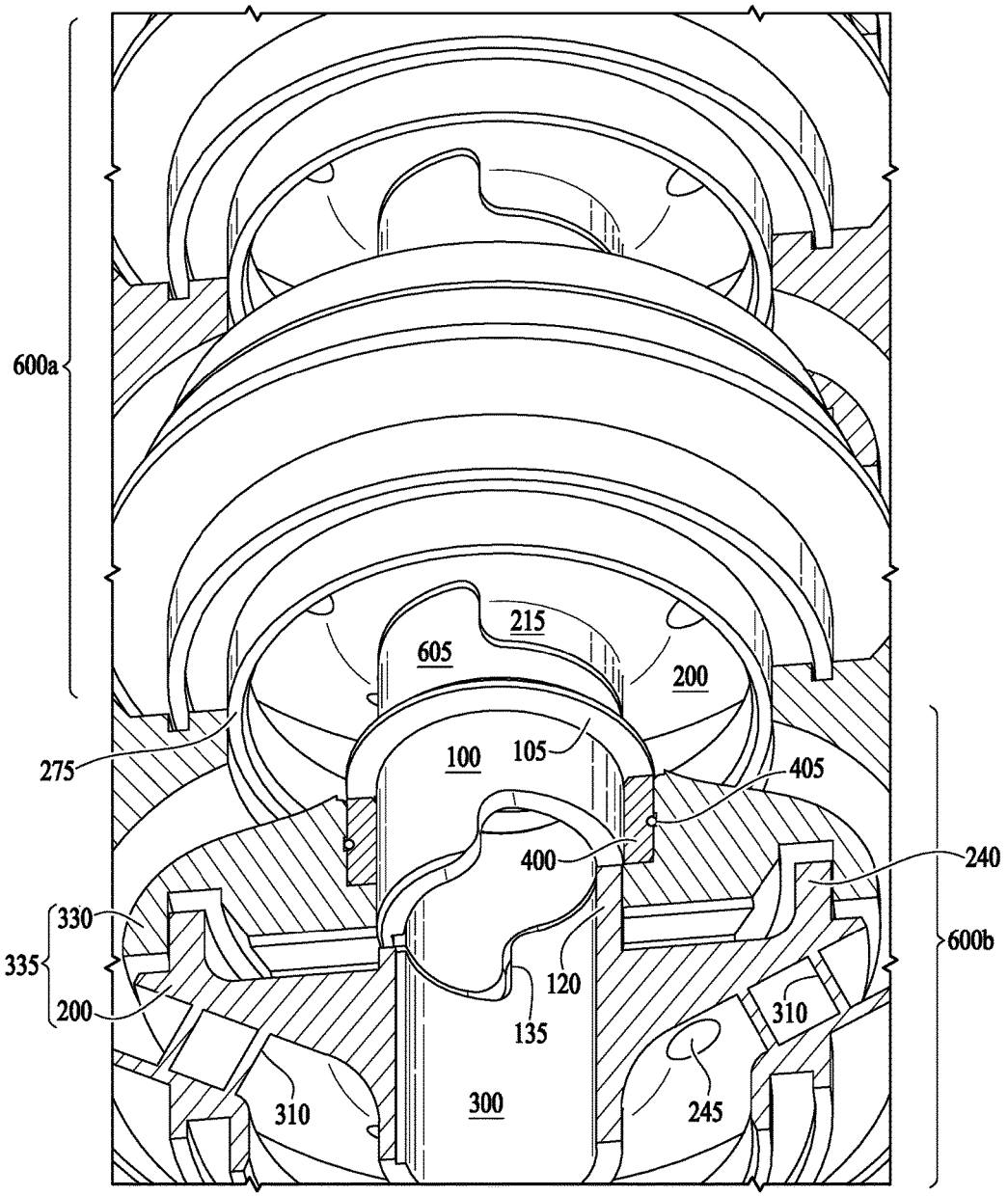
FIG. 7A is a perspective view of adjacent modules of a centrifugal pump of an illustrative embodiment.
Figure 7B:
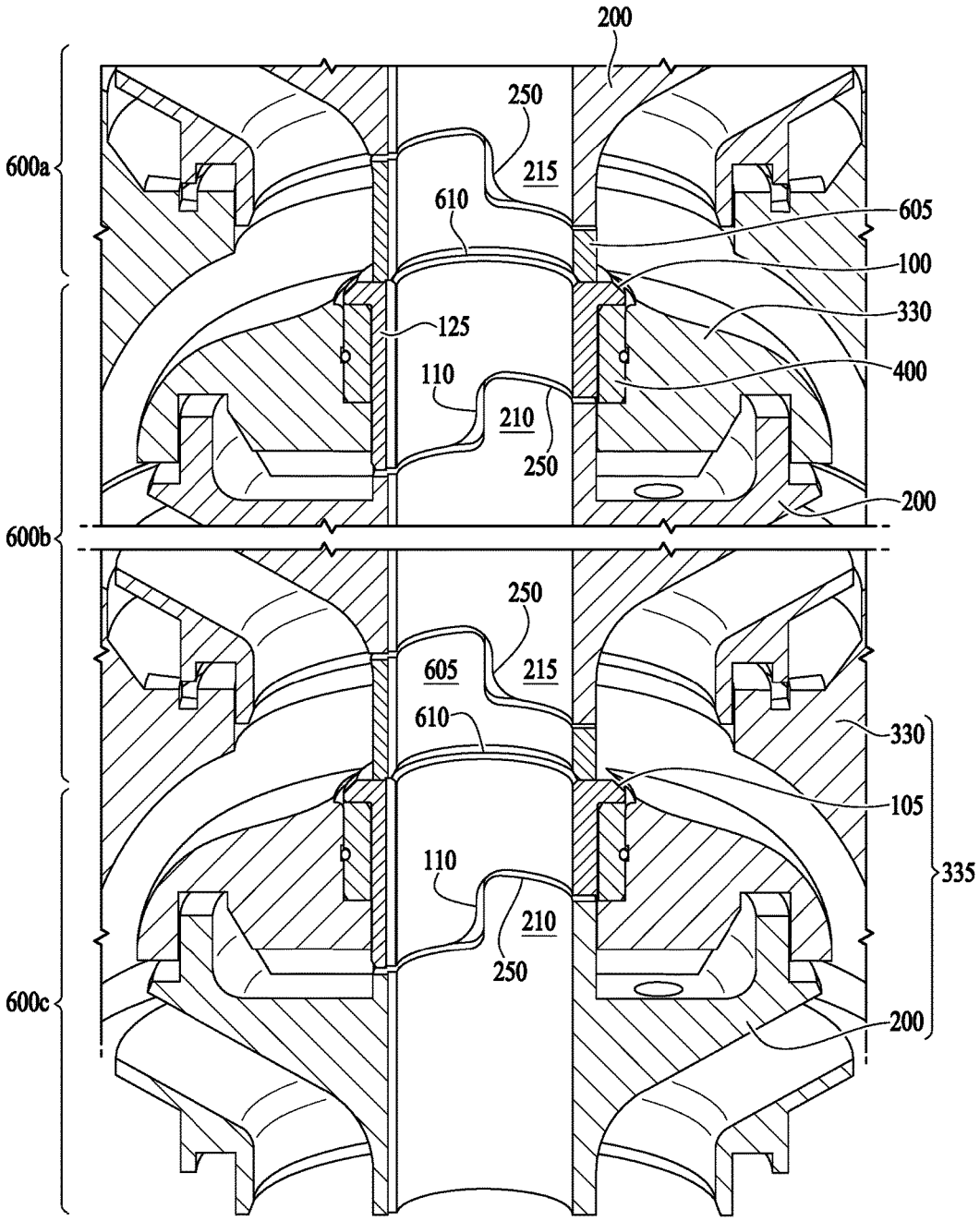
FIG. 7B is a cross sectional view of adjacent modules of a centrifugal pump of an illustrative embodiment.

FIGS. 7A-7B illustrates adjacent modules 600. As shown in FIG. 7A, standoff sleeve 605 represents the bottom of first module 600*a*, and bearing sleeve 100 represents the top of second module 600*b*. In FIG. 7B, a complete module 600*b* is shown between module 600*a* and module 600*b*. In the embodiment of FIGS. 7A-7B, standoff sleeve 605 of first module 600*a* and bearing sleeve 100 of second module 600*b* are not interconnected or interlocked, and torque will not be transferred between modules 600 (inter-modularly) in the event of failure of a key 305. As shown in FIG. 7B, the bottom edge of standoff sleeve 605 includes unstepped edge 610 that extends a uniform length along shaft 300, around the full circumference of standoff sleeve 605. Tubular portion 125 of sleeve 100 adjacent standoff sleeve 605 does not extend longitudinally past flange 105 and does not interlock with the standoff sleeve 605 above. Alternatively, the bearing sleeve 100, impellers 200 and standoff sleeve 605 within each module 600 may be interconnected and torque may be transferred between those intra-module 600 components through stepped edges 250, 110 within one or more modules 600 as described herein, in the event of reduction or failure of the torque transmitting capability of a key 305 within a module 600.

Figure 8:
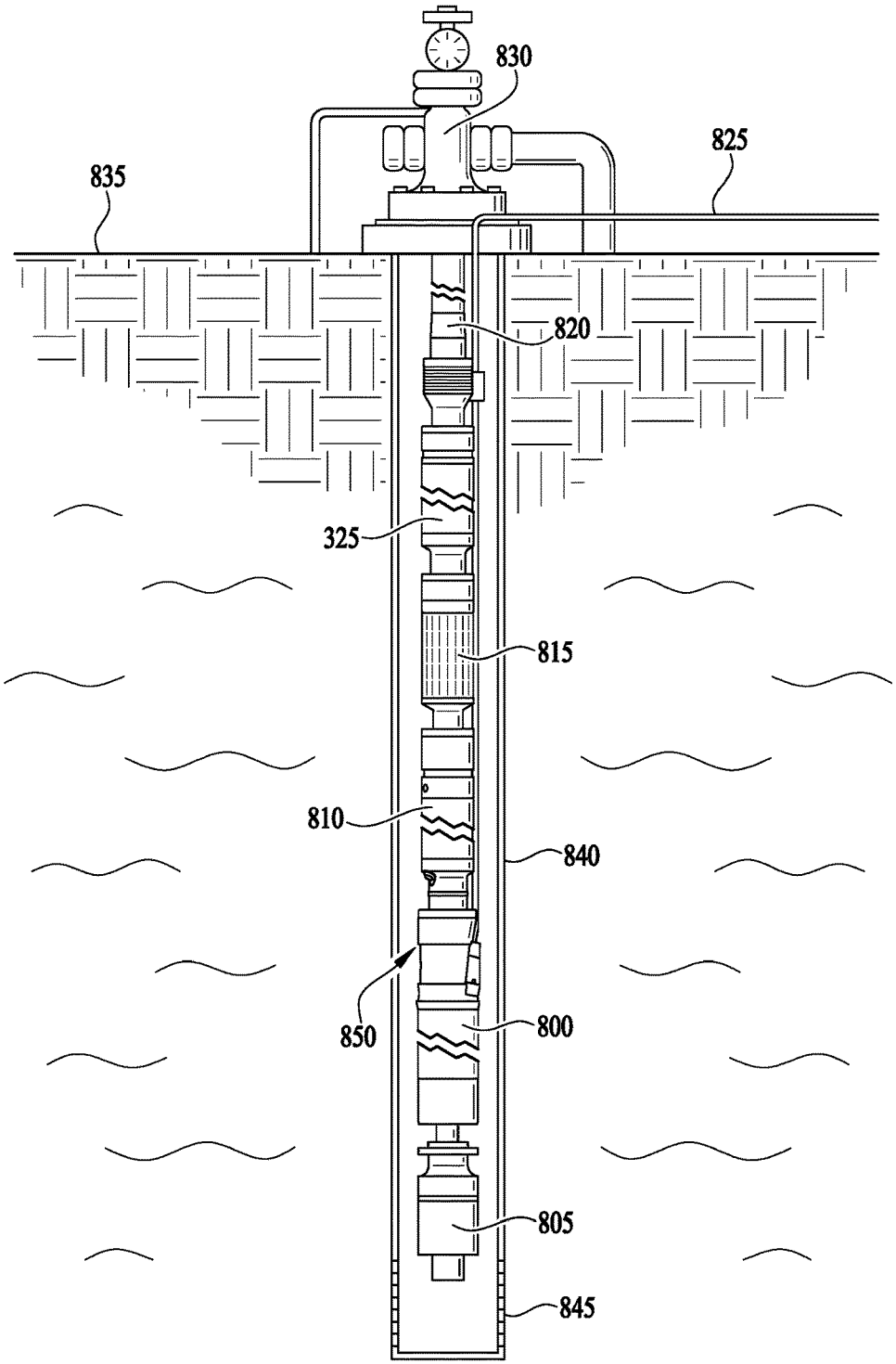
FIG. 8 is a perspective view of an electric submersible pump assembly of an illustrative embodiment.

FIG. 8 illustrates an exemplary electric submersible pump assembly that may employ a torque transfer system of illustrative embodiments. Multistage centrifugal pump 325 may be situated in a downhole well, such as an oil or natural gas well. Fluid may enter casing 840 through perforations 845 in casing. Downhole well and/or ESP assembly 850 may be vertical, horizontal or operate within a bend or radius. Electric submersible motor 800 may operate to turn shaft 300 of centrifugal pump 325 and may be a two-pole, three phase squirrel cage induction motor. Power cable 825 may provide power to motor 800 from a power source located at surface 835 of the well. In gaseous wells, a gas separator and/or a tandem charge pump may be included in ESP assembly 850 and may also include stages 335 and/or modules 600 of illustrative embodiments. Gas separator and/or intake section 815 may serve as the intake for fluid into centrifugal pump 325. Seal section 810 may equalize pressure in motor 800 and keep well fluid from entering motor 800. Production tubing 820 may carry lifted fluid to wellhead 830 and/or surface 835 of the well. Downhole sensors 805 may be mounted internally or externally to ESP assembly 850, below, above, and/or proximate motor 800. One or more of these components of ESP assembly 850 may include stepped interlocked edges 110, 250 as described herein when a plurality of adjacent, rotatable keyed elements are included with the EPS assembly 850 component.

A torque transfer system for centrifugal pumps has been described. Illustrative embodiments may provide a secondary torque transfer system in centrifugal pumps employing keys as the primary torque transfer mechanism. Upon weakening or failure of a torque transmitting key, stepped, interconnected edges between a sleeve, impeller and/or standoff sleeve within a module may contact one another along a longitudinal surface to transfer toque between the rotatable components despite weakening or failure of the key. Illustrative embodiments may reduce the instance of shaft break and/or bearing failure, and may improve reliability independent of which particular key within a continuously keyed module shears, weakens or breaks, without the need for additional components added into the pump.

Further modifications and alternative embodiments of various aspects of the invention may be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the scope and range of equivalents as described in the following claims. In addition, it is to be understood that features described herein independently may, in certain embodiments, be combined.

What is claimed is:

1. A torque transfer system for a centrifugal pump comprising:

a bearing sleeve above an impeller, the bearing sleeve and a hub of the impeller surrounding a rotatable shaft and coupled to the rotatable shaft by a key, the bearing sleeve having a stepped bottom edge;

a top edge of the hub stepped inversely to the bottom edge of the bearing sleeve such that the top edge and the bottom edge interlock with a clearance between longitudinally extending portions of the interlocked edges;

wherein upon reduction of torque transference between the key and the bearing sleeve, the clearance closes such that the longitudinally extending portion of the stepped top edge contacts the longitudinally extending portion of the stepped bottom edge thereby maintaining rotation of the bearing sleeve with the rotatable shaft.

2. The torque transfer system of claim 1, wherein the longitudinally extending portion of the stepped bottom edge of the bearing sleeve defines a driving surface of the bearing sleeve, the driving surface below a bearing surface of the bearing sleeve, and further comprising a non-rotatable bushing around the bearing surface.

3. The torque transfer system of claim 2, wherein the bearing sleeve comprises a flange extending radially outward around the top of the sleeve over the bushing, wherein the flange carries thrust of the centrifugal pump.

4. The torque transfer system of claim 2, wherein the key is seated in a keyway that extends along an inner diameter of the bearing surface of the sleeve, along an inner diameter of the driving surface of the sleeve, and continues from the inner diameter of the driving surface of the sleeve along an inner diameter of a hub surface.

5. The torque transfer system of claim 1, further comprising a standoff sleeve above the bearing sleeve, the standoff sleeve comprising a stepped top edge interlocked with a bottom end of a second hub of a second impeller above the standoff sleeve.

6. The torque transfer system of claim 1, wherein the reduction of torque transference causes asynchronous rotation between the bearing sleeve and the rotatable shaft to close the clearance.

7. A centrifugal pump comprising:

a module, comprising:

a rotatable shaft;

a series of impellers stacked on the rotatable shaft, each impeller comprising a hub secured to the rotatable shaft by a key, the series of impellers comprising an uppermost impeller and a lowermost impeller;

a flange sleeve keyed to the rotatable shaft above the uppermost impeller;

a standoff sleeve keyed to the rotatable shaft below the lowermost impeller; and each impeller of the series of impellers comprising a stepped edge on a top end of the hub and a stepped edge on a bottom end of the hub, wherein ends of opposing hubs are inversely stepped so as to interlock with a first clearance between longitudinal portions of the opposing stepped edges;

the top end of the hub of the uppermost impeller interlocked with a stepped bottom edge of the flange sleeve with a second clearance between longitudinal portions of the opposing stepped edges; and the bottom end of the hub of the lowermost impeller interlocked with a stepped upper edge of the standoff sleeve with a third clearance between longitudinal portions of the opposing stepped edges.

8. The centrifugal pump of claim 7, wherein a plurality of the modules are stacked on the rotatable shaft with a first module standoff sleeve above a second module flange sleeve, wherein each of a bottom of the first module standoff sleeve and a top of the second module flange sleeve are uniform in longitudinal length.

9. The centrifugal pump of claim 7, wherein there are between two and four impellers in the series of impellers.

10. The centrifugal pump of claim 7, wherein upon reduction of torque transference of the key, the first, second and third clearances close such that contact between the longitudinal portions of the stepped opposing edges maintains rotation of the flange sleeve, the standoff sleeve and the series of impellers with the rotatable shaft.

11. The centrifugal pump of claim 7, wherein the flange sleeve comprises a bearing surface and a driving surface, wherein the driving surface comprises the longitudinal portion, and further comprising a non-rotatable bushing surrounding the bearing surface.

12. A torque transfer system for a centrifugal pump comprising:

a rotatable shaft extending longitudinally through a hub of an impeller;

the hub coupled to the rotatable shaft by a key;

a sleeve secured to the rotatable shaft by the key, the sleeve above the impeller and comprising:

a bearing surface extending circumferentially around the rotatable shaft;

a driving surface, the driving surface between the bearing surface and a top portion of the hub; and the driving surface extending partially around the rotatable shaft to form a stepped bottom edge of the sleeve;

the top portion of the hub stepped inversely to the bottom edge of the sleeve with a clearance between longitudinally extending portions of the top portion of the hub and the bottom edge of the sleeve;

wherein upon reduction of torque transference between the key and the sleeve, the clearance closes such that contact between the longitudinally extending portions maintains rotation of the sleeve with the rotatable shaft.

13. The torque transfer system of claim 12, wherein the key extends across an inner diameter of the radial bearing surface and the driving surface of the sleeve.

14. The torque transfer system of claim 12, wherein the sleeve comprises a radially extending flange around a top of the bearing surface.

15. The torque transfer system of claim 12, further comprising a bushing extending around the bearing surface.

16. A centrifugal pump comprising:

a rotatable shaft;

a sleeve extending axially below a radially extending flange, the sleeve keyed to the rotatable shaft and comprising:

a bearing surface extending circumferentially around the rotatable shaft a first axial length below the flange, a driving surface extending from and below the bearing surface partially around the rotatable shaft a second axial length below the bearing surface, the second axial length defined by a pair of longitudinally extending edges, and wherein a bottom edge of the bearing surface, a bottom edge of the driving surface and the pair of longitudinally extending edges together form a stepped sleeve edge;

an impeller around the rotatable shaft below the sleeve, the impeller comprising a hub;

a top end of the hub comprising a hub edge stepped inversely to the sleeve edge; and the hub edge and the stepped sleeve edge interlocked.

17. The centrifugal pump of claim 16, wherein the bearing surface and the driving surface of the sleeve are coupled to the rotatable shaft by a key.

18. The centrifugal pump of claim 17, wherein upon shearing of the key, contact between the one of the pair of longitudinally extending edges and a longitudinal portion of the hub edge maintain rotation of the sleeve with the rotatable shaft.

19. The centrifugal pump of claim 16, further comprising a non-rotatable bushing extending around the bearing surface of the sleeve.

20. The centrifugal pump of claim 19, wherein the bushing has a length substantially equal to the first axial length.

21. The centrifugal pump of claim 16, wherein a bottom end of the hub is stepped inversely to a top end of a second hub of a second impeller keyed to the rotatable shaft.

22. The centrifugal pump of claim 21, wherein contact between the bottom end of the hub and the top end of the second hub transfers torque between the impeller and the second impeller.

* * * * *